United States Patent [19]

Watson et al.

[11] Patent Number: 5,000,158

[45] Date of Patent: Mar. 19, 1991

[54] STAGED BURNING RADIANT TUBE

[75] Inventors: James E. Watson, Southgate, Mich.; Theodore E. Davies, Hudson, Ohio

[73] Assignee: North American Manufacturing Company, Cleveland, Ohio

[21] Appl. No.: 393,251

[22] Filed: Aug. 14, 1989

[51] Int. Cl.[5] ..... F24C 3/00

[52] U.S. Cl. ..... 126/91 A; 432/209; 432/148

[58] Field of Search ..... 126/91 A; 432/102, 148, 432/213, 209; 431/351

[56] References Cited

U.S. PATENT DOCUMENTS

| | | | |
|---|---|---|---|
| 1,547,156 | 7/1925 | Loepsinger | 126/91 A |
| 2,091,980 | 9/1937 | Hamlink | 126/91 A |
| 4,798,192 | 1/1989 | Maruko | 126/91 A |
| 4,856,492 | 8/1989 | Kawamoto | 126/91 A |

FOREIGN PATENT DOCUMENTS

| | | | |
|---|---|---|---|
| 95005 | 7/1980 | Japan | 126/91 A |
| 74508 | 5/1982 | Japan | 126/91 A |

*Primary Examiner*—Carroll B. Dority

*Attorney, Agent, or Firm*—Woodling, Krost & Rust

[57] ABSTRACT

An improved radiant tube heater is disclosed utilizing a burner operating with an excess of either gas or air together with the remote injection of the required air or gas to match the excess and produce a staged combustion.

13 Claims, 3 Drawing Sheets

STAGED BURNING RADIANT TUBE

BACKGROUND OF THE INVENTION

The present invention relates to an improvement for tube heaters including radiant tube heaters.

Tube heaters are devices utilized to transfer heat from burners to a material while also isolating the atmosphere about the materials from the products of combustion of the burners. The tube heaters themselves can be uni-directional or bi-directional. Uni-directional heaters have a single, continuously firing burner at one end of the tube and an exhaust at the other. Bi-directional heaters have an alternately, selectively operating burner with air preheating, regenerative heat-exchange matrix and exhaust at both ends of the tube. Either type of tube heater is functional. However, in both types of devices a difficulty is experienced in controlling the combustion intensity along the length of the tube. This creates a maldistribution of temperature along such length. This maldistribution of temperature can cause shortened life of the tube, undesirable heat flux distribution into the process, and less effective use of the entire tube surface area. While the bi-directional, regenerative arrangement is better than the uni-directional, the gross BTU of either input must be limited for a specific tube diameter. This is particularly troublesome for tubes with large length/diameter ratios. Heat recovery devices that reclaim waste heat by preheating combustion further exacerbate the aforementioned problem due to higher flame temperatures. In addition to the temperature distribution problems of tube heaters, nitrogen oxide generation is also increased by higher flame temperature.

These problems limit the market for tube heaters.

SUMMARY OF THE INVENTION

The invention of this application is directed towards improving the operation of tube heaters.

It is an object of this invention to improve the distribution of burning within a tube heater and improve the utilization of tube surface for heat transfer.

It is an object of this invention to lower the production of nitrogen oxides in a tube heater.

It is an object of this invention to lengthen the service life of tube heaters.

It is an object of this invention to reduce the number of burners necessary to heat a given length of tube.

Other objects and a more complete understanding of the invention may be had by referring to the following specification and drawings in which:

DETAILED DESCRIPTION

Figure 1:
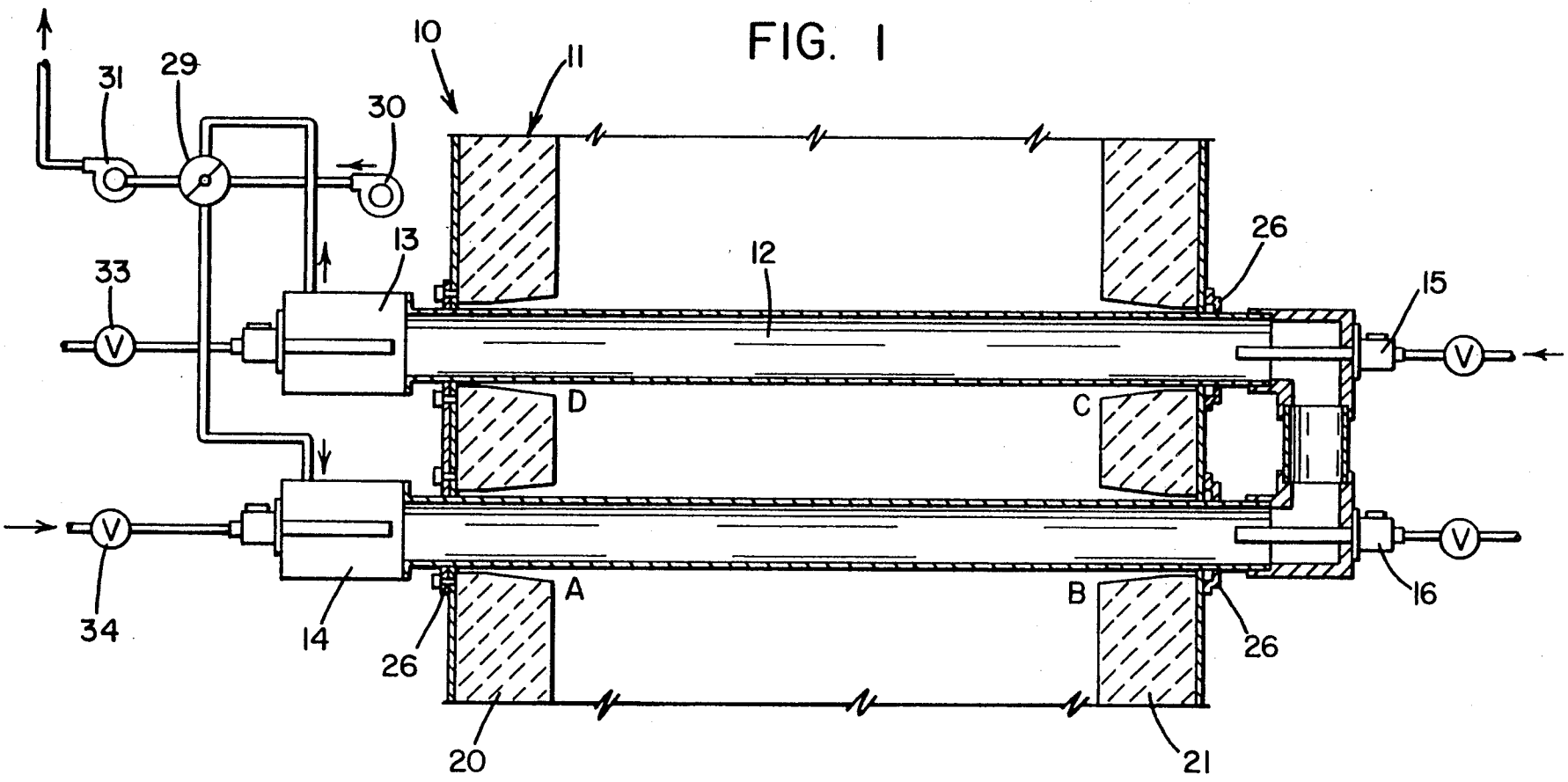
FIG. 1 is a radiant tube heater incorporating the staged burning operation of the invention.

The preferred tube heater 10 of FIG. 1 includes a furnace 11, a tube 12, two burners 13, 14 and two auxiliary injectors 15, 16.

The furnace 11 is designed to contain the material being heated in position in respect to the tube 12. The material can be solid, fluidic, or gaseous. In the preferred embodiment shown the furnace 11 is designed to heat a solid material in a protective atmosphere via indirect radiation. This furnace 11 is built of refractory brick with walls approximately five feet apart. The material to be heated is placed within this furnace 11 through doors (not shown) and located in proximity to the tube 12 to be heated thereby. Other types of containers could also be utilized if desired.

The tube 12 is designed to contain the products of combustion from the burners while transferring the heat thereof to the material within the furnace 11. In the embodiment shown this tube 12 is a radiant tube consisting of two heat resistant alloy tubes approximately 6 inches in diameter and sixteen feet in length. This tube 12 is converted into a "u" shape by addition of the tube coupler for staged firing or fuel injection. The tube 12 is sealed to the walls 20, 21 of the furnace 11 by packing glands 26 to seal the atmosphere within the furnace 11. Other shapes and orientations could also be utilized within the confines of the invention if desired.

The tube 12 is heated by a pair of burners 13, 14. In the embodiment shown these burners 13, 14 are 500,000 BTU regenerative burners. These two burners 13, 14 are selectively connected to a source of combustion air 30 and exhaust 31 and gas for alternate firing and exhaust. In the embodiment shown there is a first mode where the active burner 14 would be connected to the source 30 of combustion air and gas via valves 29 and 34 respectively with the inactive burner 13 connected to the exhaust 31 via the valve 29 (as shown in FIG. 1) and a second mode with the active burner 13 connected to the source 30 of combustion air and gas via valves 29 and 33 respectively with the now inactive burner 14 connected to the exhaust 31 via valve 29.

Figure 2:
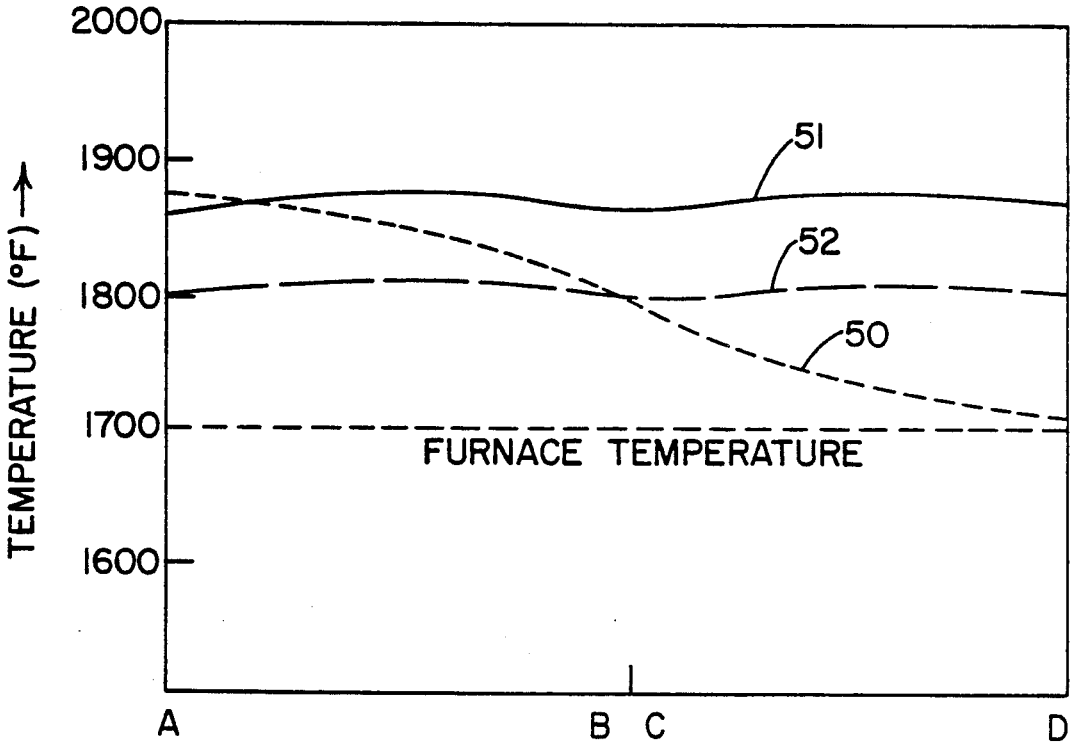
FIG. 2 is a graph of the average tube temperature distribution profile along the tube of various radiant tube heaters including that of FIG. 1.

If the source of combustion air 30 and gas 33, 34 provided 100% of the fuel or oxidant directly to the burners 13, 14, this alternate firing would produce an uneven temperature distribution within the tube 12 due to input rate, transfer-area relationship. This temperature distribution 50 as shown for a single active burner 14 in FIG. 2 is typified by a high temperature along the length of the tube neighboring the firing burner 14 with the temperature dropping off significantly along the length of the inactive burner 13. This temperature is uneven in respect to the length of the tube (i.e. A to B is higher than C to D during the firing of burner 14) and in respect to the time of firing of the burners (i.e. the temperature of A to B is high during the firing of burner 14 and low during the alternate firing of burner 13). In addition the temperature maldistribution is itself symptomatic of fast combustion (i.e. most combustion taking place in the first five feet of the tube 12 closest to the firing burner). This type of quick firing produces significant levels of nitrogen oxides. These and other problems arising from or related to the combustion parameters of the furnace are undesirable. The burner graphed provides 9173 BTU/hour for each square foot of surface area for a 500,000 BTU burner input.

In the invention of this present application 100% of the combustion air and gas are not provided directly by the particular burner (or additional burners). Instead part of at least one of the air or gas is provided a spaced distance away therefrom via auxiliary injectors. In the preferred embodiment shown the auxiliary injectors 15, 16 are used to inject gas halfway along the radiant tube 12 and each burner 13, 14 is operated with 100% excess air. For example if the ratio of gas to air for complete combustion was 1,000 cubic feet per hour (CFH) of gas to 10,000 CFH air, the burners 13, 14 would be operated with 500 CFH gas and 10,000 CFH air and the corresponding auxiliary injector 15, 16 operated with 500 CFH gas (thus supplying the deficient substance). This operation would produce substantially half of the combustion to the point of injection with the remaining combustion occurring after the point of injection. In the embodiment shown the point of injection (i.e. at C, D) is half way along the length of the tube 12 (i.e. A to B) to match the 100% excess air injection of the burners set forth herein. This staged combustion acts to equalize the temperature distribution along the length of the tube 12 and in respect to the time of firing of the burners 13, 14 (line 5D in FIG. 2). This staged combustion also significantly reduces the production of nitrogen oxides within the tube (550 to 80 ppm nox). The staged combustion also allows one to operate the radiant tube at a lower temperature for a given desired furnace temperature (line 52 in FIG. 2) (with the deviation from the median temperature of the tube being lower, the entire length of the tube can be retained at a lower temperature while still providing the same BTU output, thus, prolonging tube life). The burner graphed provides 9190 BTU/hour for each square foot of surface area for a 500,000 BTU input burner in bi-directional firing. Alternately, the tube may be operated at a firing rate to produce the temperature profile of curve 51 giving much increased production from furnace with tube life equivalent to one-way burner. The burner graphed provides 18,346 BTU/hour for each square foot of surface area for a 500,000 BTU input burner in bi-directional firing.

The auxiliary injectors 15, 16 are simple devices, making up a deficiency otherwise present. These injectors 15, 16 do not have the complexity of burners. Indeed the injectors actually eliminate the need for further burners to heat the tube 12. The injectors 15, 16 thus produce their advantages without the attendant costs or complexity associated with additional burners. Note that the injectors 15, 16 shown in the preferred embodiment are located at the ends of their respective tube lengths D-C, B-A having an unobstructed access to such tube lengths. This is preferred so as to reduce the thermal stress on the tube 12. A single injector operating for both burners 13, 14 or other injector orientation could be utilized if desired to make up the deficiency.

The operation of the furnace with 100% excess in the burners 13, 14 is preferred due to the ease in providing gas to remote locations; a gas line is smaller and easier to connect than an auxiliary blower or remote air supply. The use of excess air also lessens the need to purge the burners 13, 14 before reversal; the burners 13, 14 can be made self purging by eliminating the injection of gas just before reversal. The invention, however, works equally well with the use of excess gas at the burners.

It is preferred that the location of the auxiliary injectors substantially correlate with the degree of excess condition so as to optimize the combustion within the tube. Note that multiple spaced auxiliary injectors can be utilized if desired, preferably with the percentage of deficiency injection matching the approximate location of the injector. For example instead of one auxiliary injector described and located halfway along the tube to make up 100% of a deficiency, two injectors located one third and two thirds along the tube could be utilized instead with each injector making up substantially 50% of the deficiency.

Figure 3:
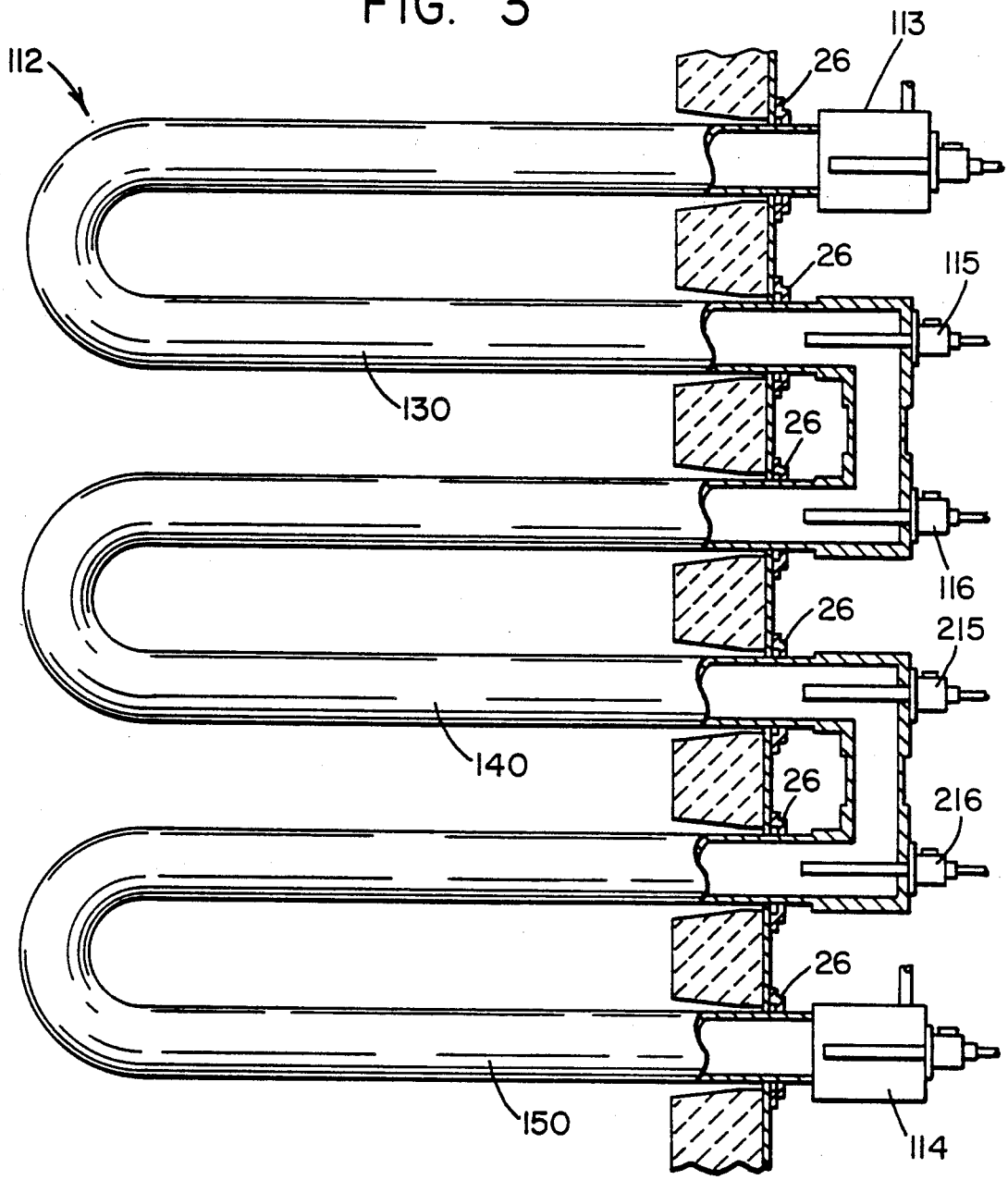
FIG. 3 is a second tube heater incorporating the staged burning operation of the invention.

FIG. 3 discloses an embodiment incorporating multiple spaced injectors. In this embodiment the tube 112 includes three u tubes 130, 140, 150 and two injector sets 115, 116, 215, 216 instead of two straight tubes and a single injector set 15, 16 as in the heater of FIG. 1. In this embodiment each injector 115, 215, 116, 216 makes up substantially 50% of the deficiency of the corresponding burner 114, 113. The embodiment of FIG. 3 operates similarly to the embodiment of FIG. 1. Note that the utilization of u tubes 130, 140, 150 places the burners 113, 114 and the auxiliary injectors 115, 116, 215, 216 on a single side of the furnace. This facilitates construction and maintenance of the heater. It also further reduces the number of burners and/or auxiliary injectors needed to heat the tube 112. Other injector locations with varying percentage of deficiency injections could be utilized if desired and/or were appropriate to optimize the heat transfer function/operating parameters of the heater.

Although the invention has been described in its preferred form with a certain degree of particularity, it is to be understood that numerous changes may be made without deviating from the invention as hereinafter claimed.

What is claimed is:

1. In a tube heater having a length and a burner requiring gas and air on one end thereof, the tube heater utilized in a furnace having an inside and an outside, the improvement comprising means for operating the burner with excess gas or air, the tube heater extending outside of the furnace at a location along the length thereof, means for injecting a supplementary amount of the deficient air or gas respectively at said location along the length of the tube to combust with the excess gas or air from the burner and produce stage combustion, a second burner, said second burner being on the other end of the tube, said second burner also requiring gas and air, means for operating said second burner with excess gas or air and means for injecting a supplementary amount of air or gas respectively at said location along the length of the tube to combust with the excess gas or air from said second burner.

2. The tube heater of claim 1 characterized in that said location is located substantially half way along the length of the tube.

3. The tube heater of claim 1 characterized in that said burner and second burner are operated with excess air.

4. In a radiant tube heater having a tube shaped in a generally "u" shape with first and second legs having alternately firing first and second burners respectively requiring gas and air at the ends thereof, the tub heater utilized in a furnace having an inside and an outside, the improvement comprising means for operating the burners with excess gas or air, the tube heater extending outside of the furnace at a location along the length thereof, means for injecting a supplementary amount of air or gas respectively for the first burner into the second leg of the tube at said location during the firing of the first burner and means for injecting a supplementary amount of the deficient air or gas respectively for the second burner into the first leg of the tube at said location during the firing of the second burner so as to produce staged combustion.

5. The radiant tube heater of claim 4 characterized in that said burner and second burner are operated with excess air.

6. The radiant tube heater of claim 1 characterized in that said location is located substantially half way along the length of the tube.

7. The radiant tube heater of claim 4 characterized in that said first and second burners are operated with 100% excess air.

8. A radiant tube heater for a furnace having walls and an inside and an outside, the radiant tube heater comprising a tube, said tube having two ends, said tube being located on the inside of the furnace with said two ends extending to the outside thereof, a burner, said burner located on one of said ends of said tube outside of the furnace, a second tube, said second tube having two ends, said second tube located inside of the furnace with said two ends extending to the outside thereof, a tube coupler, said tube coupler being located outside of the furnace connecting the other end of said tube to one of said two ends of said second tube, an auxiliary injector, said auxiliary injector being located in said tube coupler, means for operating said burner with excess gas or air, means for operating said injector with a supplementary amount of the deficient air or gas to combust with the excess gas or air from said burner and produce staged combustion, and said burner being a bi-directional regenerative burner.

9. A radiant tube heater for a furnace having walls and an inside and an outside, the radiant tube heater comprising a tube, said tube having two ends, said tube being located on the inside of the furnace with said two ends extending to the outside thereof, a burner, said burner located on one of said ends of said tube outside of the furnace, a second tube, said second tube having two ends, said second tube located inside of the furnace with said two ends extending to the outside thereof, a tube coupler, said tube coupler being located outside of the furnace connecting the other end of said tube to one of said two ends of said second tube, an auxiliary injector, said auxiliary injector being located in said tube coupler, means for operating said burner with excess gas or air, means for operating said injector with a supplementary amount of the deficient air or gas to combust with the excess gas or air from said burner and produce staged combustion, a second burner, said second burner being located on the other end of said two ends of said second tube, and means for operating said second burner with excess gas or air, and means for operating said injector to inject a supplementary amount of air or gas respectively to combust with the excess gas or air from said second burner.

10. The tube heater of claim 9 characterized in that said burner and said second burner are bi-directional regenerative burners.

11. A radiant tube heater for a furnace having an inside and an outside separated by walls, the tube heater comprising a first tube, said first tube having two ends, said first tube being located on the inside of the furnace with said two ends thereof extending through the walls to the outside of said furnace, a first burner, said first burner being located on one end of said first tube, a second tube, said second tube having two ends, said second tube being located on the inside of said furnace with said two ends thereof extending through the walls to the outside of the furnace, a tube coupler, said tube coupler being located outside of the furnace, said tube coupler joining the second end of said first tube with an end of said second tube, an auxiliary injector, said auxiliary injector being located in said tube coupler, a second burner, said second burner being located outside of said furnace on the other end of said second tube, means for operating said first burner with excess gas or air, means for operating said second burner with excess gas or air, and means for operating said auxiliary injector with a supplementary amount of air or gas respectively for said first burner into said second tube and said second burner into said first tube for injecting a supplementary amount of the deficient air or gas respectively for said burners into said tubes so as to produce a staged combustion.

12. The tube heater of claim 11 characterized in that said first burner and said second burner are bi-directional regenerative burners.

13. A radiant tube heater for a furnace having an inside and an outside separated by walls, the tube heater comprising a first tube, said first tube having two ends, said first tube being located on the inside of the furnace with said two ends thereof extending through the walls to the outside of said furnace, a first burner, said first burner being located outside of the furnace on one end of said first tube, a second tube, said second tube having two ends, said second tube being located on the inside of said furnace with said two ends thereof extending through the walls to the outside of the furnace, a tube coupler, said tube coupler being located outside of the furnace, said tube coupler joining the other end of said first tube with an end of said second tube, an auxiliary injector, said auxiliary injector being located in said tube coupler in line with said end of said second tube with unobstructed access to said second tube, a second auxiliary injector, said second auxiliary injector being located in said tube coupler in line with said other end of said first tube with unobstructed access to said first tube, a second burner, said second burner being located outside of said furnace on the other end of said second tube, means for operating said first burner with excess gas or air, means for operating said second burner with excess gas or air, means for operating said second auxiliary injector with a supplementary amount of air or gas respectively for said first burner into said second tube for injecting a supplementary amount of the deficient air or gas respectively for said first burner into said second tube so as to produce a staged combustion, and means for operating said auxiliary injector with a supplementary amount of air or gas respectively for said second burner into said first tube for injecting a supplementary amount of the deficient air or gas respectively for said second burner into said first tube so as to produce a staged combustion.

* * * * *